US011090793B2

(12) United States Patent
Ji

(10) Patent No.: US 11,090,793 B2
(45) Date of Patent: Aug. 17, 2021

(54) NAILING UNIT AND NAIL GUN COMPRISING SAID NAILING UNIT

(71) Applicant: HANGZHOU XINXING OPTICAL ELECTRONICS CO., LTD., Hangzhou (CN)

(72) Inventor: Shian Ji, Hangzhou (CN)

(73) Assignee: HANGZHOU XINXING OPTICAL ELECTRONICS CO., LTD., Hangzhou (CN)

( * ) Notice: Subject to any disclaimer, the term of this patent is extended or adjusted under 35 U.S.C. 154(b) by 192 days.

(21) Appl. No.: 16/357,728

(22) Filed: Mar. 19, 2019

(65) Prior Publication Data

US 2020/0230793 A1 Jul. 23, 2020

(30) Foreign Application Priority Data

Jan. 18, 2019 (CN) ..... 201910046134.X

(51) Int. Cl.
*B25C 1/00* (2006.01)
*B25C 5/16* (2006.01)

(52) U.S. Cl.
CPC ..... *B25C 5/1651* (2013.01); *B25C 1/005* (2013.01); *B25C 5/1617* (2013.01)

(58) Field of Classification Search
CPC ..... B25C 5/1651; B25C 5/1671; B25C 1/005
USPC ..... 227/109
See application file for complete search history.

(56) References Cited

U.S. PATENT DOCUMENTS 4,327,858 A * 5/1982 Powers ..... B25C 5/16 227/120
4,380,312 A * 4/1983 Landrus ..... B25C 5/06 227/116
7,048,169 B2 * 5/2006 Sun ..... B25C 1/005 227/109
7,284,685 B1 * 10/2007 Wojcicki ..... B25C 1/005 227/119
7,918,374 B2 * 4/2011 Gardner ..... F16B 15/0015 227/130
2004/0211810 A1 * 10/2004 Ho ..... B25C 1/163 227/120
2008/0296340 A1 * 12/2008 Wang ..... B25C 5/1651 227/109

* cited by examiner

*Primary Examiner* — Nathaniel C Chukwurah
(74) *Attorney, Agent, or Firm* — Muncy, Geissler, Olds & Lowe, P.C.

(57) ABSTRACT

A nailing unit and a nail gun including the nailing unit includes a guide plate, a nail box to mount staple nails or straight nails, and a nail feeding plate slidably connected to a nail compartment; the nail box is fixedly connected to a guide plate at one end, and forms a nail outlet at the position of connection; the nail feeding plate can push staple nails or straight nails to the nail outlet; bumps are fixedly provided inboard of the guide plate lengthwise; two bumps and the nail outlet form a nail discharge groove for matching the nailing plate, and suit to different specifications of straight nails or staple nails.

12 Claims, 5 Drawing Sheets

A-oriented

NAILING UNIT AND NAIL GUN COMPRISING SAID NAILING UNIT

CROSS-REFERENCE TO RELATED APPLICATION

The present application relies on, for priority, China Patent Application No. 201910046134.X entitled "NAILING UNIT AND NAIL GUN COMPRISING SAID NAILING UNIT", filed on Jan. 18, 2019, which is also herein incorporated by reference in its entirety.

FIELD OF THE INVENTION

The present invention relates to the field of nail gun, and more specifically relates to a nailing unit and a nail gun comprising said nailing unit.

DESCRIPTION OF THE PRIOR ART

With the rapid development of furniture and decoration in modern times, nail gun is more and more required as an important tool in the industry of building decoration. Among the tools, pneumatic nail gun is widely used due to its advantages of small volume, fast nailing speed and no need of external electric power supply. Meanwhile, it includes features of easy operation, convenient maintenance, reduced labor and decorating costs.

Though the nail gun in the prior art has the foregoing advantages, yet operators often need to replace straight nails or code nails of different specifications to meet the decoration requirement according to actual conditions. And at that time, the nail gun must also be changed. The frequent replacement not only reduces the working efficiency and universality, but also adds much troubles and inconvenience.

In an effort to overcome the above problems, an improved nailing unit is proposed.

SUMMARY OF THE INVENTION

Accordingly, the present invention has been keeping in mind the above problems occurring in the prior art, and the object of the present invention is to provide a nailing unit and a nail gun comprising said nailing unit that own advantages of simple structure, reasonable design and wide applicability.

The nailing unit of the present invention comprises a guide plate, a nail box to mount staple nails or straight nails, and a nail feeding plate slidably connected to said nail box;

Said nail box is fixedly connected to said guide plate at one end, and forms a nail outlet at the position of connection; Said nail feeding plate can push staple nails or straight nails to the nail outlet; One or more cuboid-shaped bumps are fixedly provided inboard of said guide plate lengthwise.

Preferably, two said bumps are symmetrically provided at both sides of the guide plate at the nail outlet.

Preferably, said bumps and the guide plate take a form of step, and therefore form a nail discharge groove between the bumps and the nail outlet.

The nail gun of the present invention comprises said nailing unit, besides, said nail gun also comprises a gun body, a nailing plate for striking staple nails or straight nails at the position of said nail outlet, a driving unit for controlling said nailing plate to reciprocate and a switch assembly for ON-OFF control of said driving unit. Said nailing plate and said driving unit are all disposed in said gun body.

Preferably, said driving unit comprises a cylinder body fixedly disposed in said gun body and a piston disposed in said cylinder body. Said piston is slidably connected to said cylinder body, and said nailing plate is fixedly connected to said piston.

Preferably, the thickness of said nailing plate matches the thickness of the nail discharge groove; Said nailing plate is disposed in the nail discharge groove, and is driven to reciprocate therein by the driving unit.

Preferably, the nail gun also comprises a locking unit for the nail box. Said locking unit for the nail box comprises a locking device fixedly disposed at the end of the nail feeding plate. There are junction plates fixedly arranged at both sides of said locking device, and hook slots are provided on the junction plates. Responsively, the gun body is provided with positioning slots for matching the hook slots. The hook slots are snap-in connected to the positioning slots to fix the position of the nail feeding plate in the nail box.

Preferably, there is provided a nailing positioning means in said gun body at the front end of the nailing unit. The nailing positioning means comprises a positioning piece, a reset shrapnel and a first guide plate in the order of arrangement; the tail of the first guide plate is socket-connected with a spring member, and the tail end of the first guide plate contacts the reset shrapnel. The first guide plate extends to the outer end of the gun body, and reciprocates by the coordinated actions of the spring member and the reset shrapnel.

Preferably, said nail guns of the present invention include electric nail guns, manual nail guns and pneumatic nail guns.

The present invention has the following advantages:

1. Bumps are fixedly provided in the inner wall of the guide plate near the nail outlet. The bumps and the nail outlet form a nail discharge groove for matching the nailing plate, and suit to widely different specifications of straight nails or staple nails.

2. In operation, an operator can slide the nail feeding plate and open the nail box, mount straight nails or staple nails in the nail box, and then close the nail feeding plate to seal the nail box. In operation, an operator can replace straight nails or staple nails of all sorts in the nail box as needed without changing the nail gun, thus improving the efficiency of decoration. Meanwhile operators needn't buy different types of nail gun to satisfy different working requirement, thus reducing cost and enhancing universality and facilitation.

3. By the arrangement of nailing positioning means in working process of nail gun, an operator can position the nail gun according to actual needs, thus avoiding nailing mistake, improving working efficiency and significantly reducing manufacturing costs.

Figure 1:
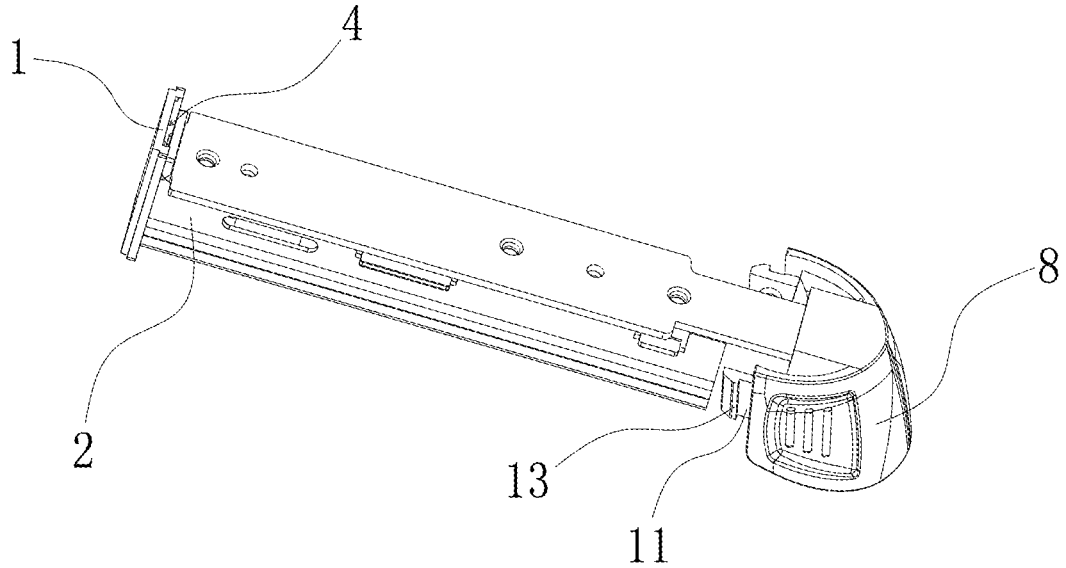
FIG. 1 is a schematic view of example 1 of the present invention.
Figure 2:
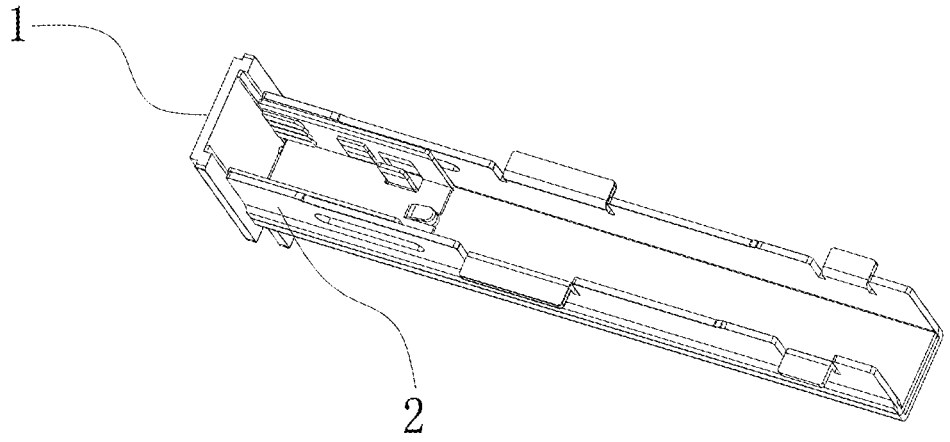
FIG. 2 is a schematic view showing the connection between guide plate and nail box of example 1 of the present invention.
Figure 3:
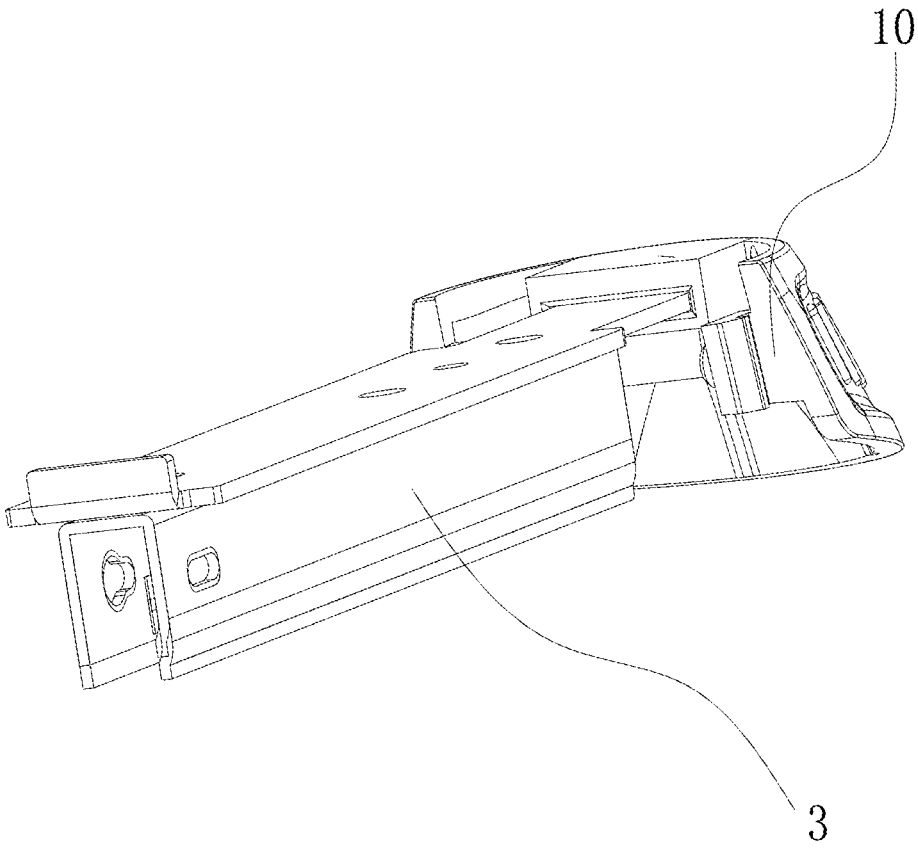
FIG. 3 is a schematic view showing the nail feeding plate example 1 of the present invention.
Figure 4:
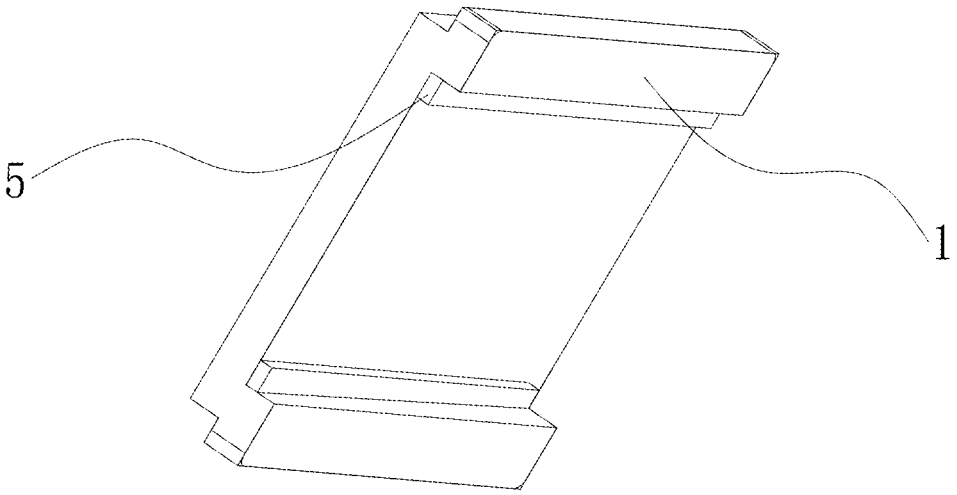
FIG. 4 is a schematic view showing the guide plate of example 1 of the present invention.
Figure 5:
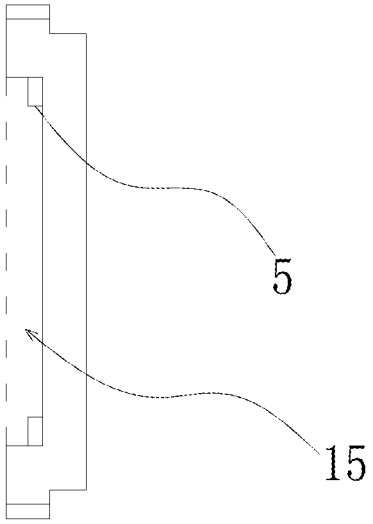
FIG. 5 is a top view showing the guide plate of example 1 of the present invention.

LEGEND IN THE FIGURES guide plate 1, nail box 2, nail feeding plate 3, nail outlet 4, bump 5, nailing plate 6, piston 7, locking device 8, gun body 9, nail box, locking unit 10, junction plate 11, hook slot 13, nail discharge groove 15, nailing positioning means 20, positioning piece 21, reset shrapnel 22, first guide plate 23, spring member 24.

DETAILED DESCRIPTION OF THE PREFERRED EMBODIMENTS

The present invention will be more clearly understood from the following detailed description taken in conjunction with the accompanying drawings. Obviously, the embodiments described are only parts of embodiments of the present invention. Although the preferred embodiment of the present invention has been disclosed for illustrative purposes, those skilled in the art will appreciate that all other embodiments based on the embodiments of the present invention without paying creative work fall within the basic teaching herein set forth, without departing from the scope and spirit of the invention as disclosed in the accompanying claims.

It should be noted that in the description of the present invention, unless otherwise specified and limited clearly, the terms "dispose", "connect", "mount" and "communicate" etc. should be understood in generalized meaning. For example, means can be connected fixedly, detachably, or integrally, mechanically or electrically, directly or indirectly via a media, or even internally in two members. Those skilled in the art can understand the meaning of the terms according to specific conditions.

Example 1

As seen in FIG. 1-5, this example provides a nailing unit of nail gun that comprises a guide plate 1, a nail box 2 to mount staple nails or straight nails, and nail feeding plate 3 slidably connected to said nail box 2; Said nail box 2 is fixedly connected to said guide plate 1 at one end, and forms a nail outlet 4 at the position of connection; Said nail feeding plate 3 can push staple nails to the nail outlet 4; a bump 5 is fixedly provided inboard of said guide plate 1 lengthwise.

A staple nail discharge groove is installed in the nail box 2 to mount staple nails, and communicates with the nail outlet 4. A bump 5 is provided on the guide plate 1, and takes a form of step jointly with the guide plate 1 to mount straight nails, and similarly bump 5 may be straight nail discharge groove. Also, the bump 5 takes a form of step jointly with the nail outlet 4 and forms a nail discharge groove 15; two bumps 5 can also be adopted and arranged symmetrically on both sides of the guide plate 1, and the bumps 5 on both sides are provided in the nail outlet 4. Said nail discharge groove 15 is used jointly with the nailing plate 6 of the nail gun. The width of nail outlet 4 suits to staple nails of typical widths, and the width of said nail discharge groove 15 includes a first width and a second width; the width of the first width is the same as that of the nail outlet 4, which suits to wider staple nails; the width of the second width is the distance between the two bumps, which suits to narrower staple nails. The specifications of the two bumps may be set according to the second width required. Therefore, the width of the nail discharge groove 15 may be arranged according to the widths of staple nails to meet different specification requirements of straight nails or staple nails.

In operation, an operator can slide the nail feeding plate 3 to open the nail box 2, mount straight nails or staple nails in the nail box 2, then close the nail feeding plate 3 to seal the nail box 2. When the operator triggers the switch, the straight nail or staple nail will be driven out under the high-rate strike of the nailing plate 6, and nailed into a wood board.

When straight nails or staple nails need to be replaced, just remove the straight nails or staple nails out of the nail box 2 and replace preferred nails into the nail box 2. As a recess 5 can also be formed in the guide plate 1 near the nail outlet 4, the recess 5 and the nail outlet 4 can jointly form the nail discharge groove 15. With the thickness of nailing plate 6 larger than that of staple nail, in cases that the thickness of staple nail is no larger than that of nail discharge groove 15, all staple nails can be operated. When the operator triggers the switch, staple nails will be driven out of the nail discharge groove 15 under the impact of the nailing plate 6. The staple nail will be nailed into wood board under the high-rate strike of the nailing plate 6.

In the structure of the nailing unit according to this embodiment, through the nail discharge groove 15 formed between the recess 5 and the nail outlet 4, straight nail can be pushed out of the step-type opening of the recess 5 by the nail feeding plate 3, and driven out of the nail discharge groove 15 under the impact of nailing plate 6 of the nail gun; When mounted in the nail box 2, staple nails are pushed to the nail discharge groove 15 under the role of nail feeding plate 3. As the shape and feature of staple nail match the opening of nail discharge groove 15, staple nail can be pushed out under the role of the nail feeding plate 3 and driven out the nail discharge groove 15 under the impact of nailing plate 6 of the nail gun. In operation, an operator can replace straight nails or staple nails of all sorts in the nail box 2 as needed without changing the nail gun, thus improving the efficiency of decoration. Meanwhile operators needn't buy different types of nail gun to satisfy different working requirement, thus reducing cost and enhancing universality and facilitation.

In this embodiment, straight nails or staple nails can be reliably mounted in the nail box 2 having a locking unit 10 therein. The locking unit 10 comprises a locking device 8 fixedly arranged at the end of the nail feeding plate 3. Both sides of said locking device 8 are fixedly provided with junction plates 11 having hook slots 13. Responsively, the gun body 9 is provided with positioning slots to match the hook slots 13. The hook slots 13 are snap-in connected to the positioning slots to fix the position of the nail feeding plate 3 in the nail box 2.

With the snap-in connection between the positioning slots and the hook slots 13, after the handle in the rear end of locking device 8 is pressed by an operator, the hook slots 13 in the junction plate 11 will be retracted, ensuring that the nail feeding plate 3 can fully seal the nail box 2 and thereafter remove the external force applied to the handle. Here the locking device 8 is restored to the impressed state before the handle is pressed, and will contact the nail feeding plate 3 tightly after an operator presses the handle. Now the hook slot 13 will be engaged by the nail feeding plate 3 to prevent the nail feeding plate 3 from being flicked under vibration in the working of nail gun and further improve the functionality and practicability of the structure of said nail gun.

To replace the straight nails or staple nails in the nail box 2, the operator can just press the handle again. Now the hook slot 13 is disengaged from the positioning slot, and the operator can easily open the nail feeding plate 3 and replace straight nails or staple nails.

In this embodiment, the height of staple nails or straight nails in the nail box 2 can be chosen as required. The nail box 2 can even be manufactured in accordance with the shape and feature of actual straight nails and staple nails. The adoption of the largest depths of straight nails and staple nails in the market can reduce manufacturing procedures and hence the costs.

The nailing unit of the present invention is applicable for electric, manual or pneumatic nail guns.

Example 2

Figure 6:
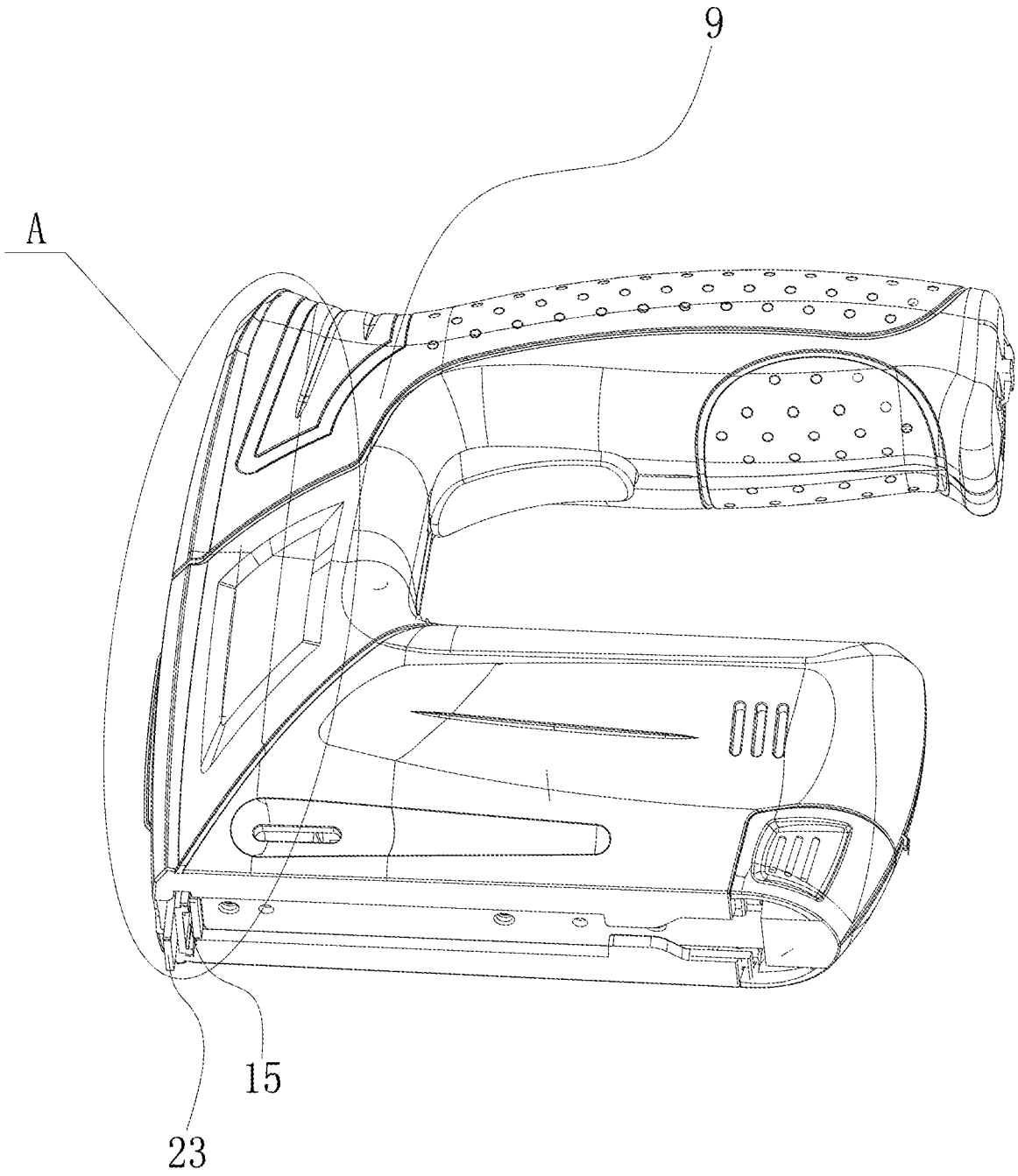
FIG. 6 is a schematic view showing the nail gun of example 2 of the present invention.
Figure 7:
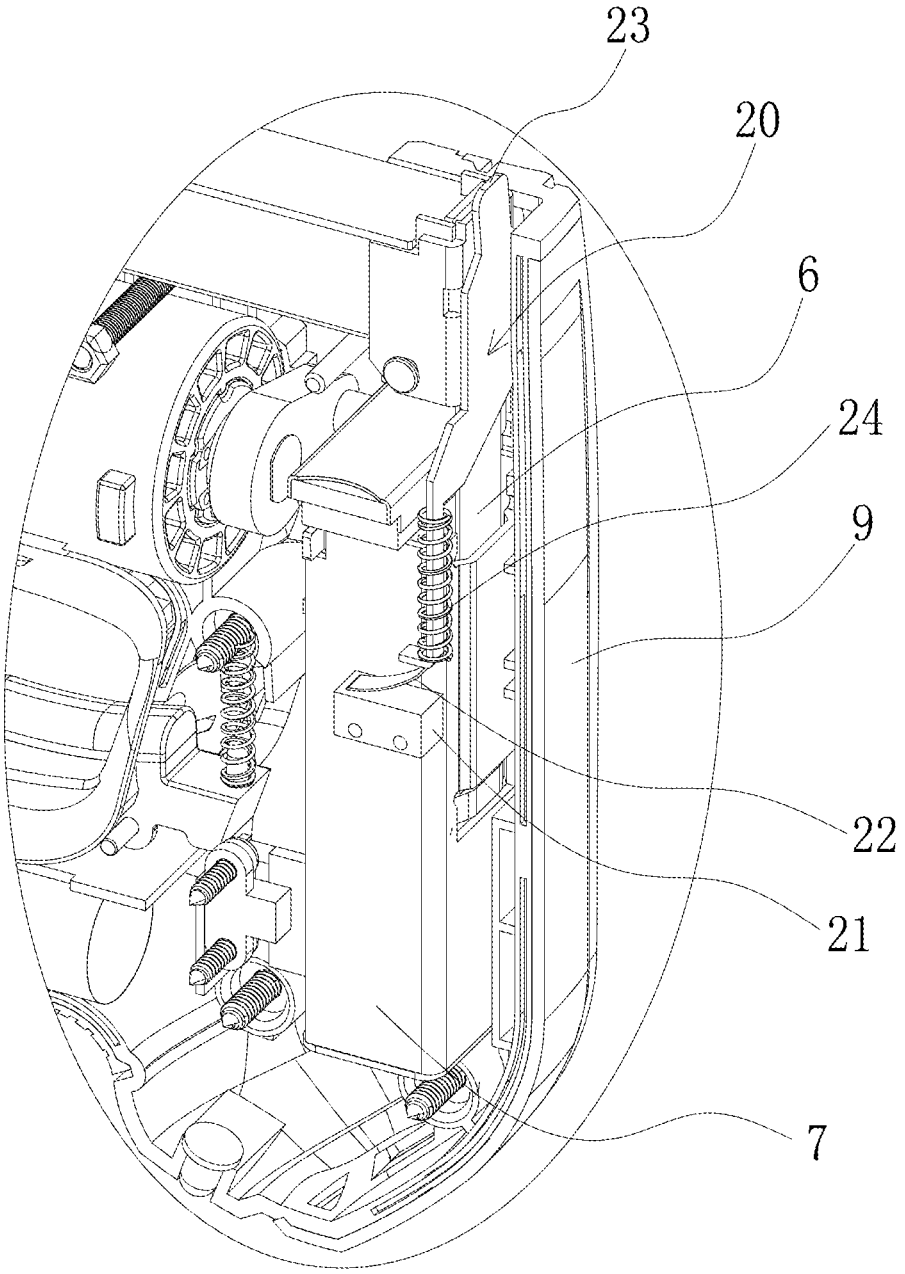
FIG. 7 is an A-oriented cutaway view of the nail gun of example 2 of the present invention.

As seen in FIG. 6-7, this example provides a nail gun that comprises the nailing unit of example 1. Said nail gun also comprises a gun body 9, a nailing plate 6 to hammer straight nails at the position of said nail outlet 4, a driving unit for controlling said nailing plate 6 to reciprocate and a switch assembly for controlling ON-OFF switch of said driving unit. Said nailing plate 6 and said driving unit are all arranged in said gun body 9.

In this embodiment, after the switch assembly of said nail gun is triggered, the driving unit will drive the nailing plate 6 to move. The nailing plate 6 moves towards the first direction and strikes straight nails or staple nails at the position of the nail outlet 4 out of the nail outlet 4; When the operator releases the switch assembly, the nailing plate 6 will move towards the second direction contrary to the first direction under the role of driving unit, and be restored to its original position, completing a cycle of nailing operation.

In this embodiment, the gun body 9 is die-cast, featuring large-scale manufacture, short process cycle, simple operation and low costs.

Specifically, the driving unit comprises a cylinder body fixedly disposed in said gun body 9 and the piston 7 in said cylinder body. Said piston 7 is slidably connected to said cylinder body, and said nailing plate 6 is fixedly connected to said piston 7.

In this embodiment, in cases that the switch assembly is triggered, the cylinder body will be fully filled with air and the piston 7 will be driven by air pressure in the cylinder body to move towards the first direction. As the nailing plate 6 is fixedly connected to the piston 7, the movement of the nailing plate 6 and the piston 7 is synchronized. Now, the nailing plate 6 strikes straight nails or staple nails at the position of the nail outlet 4 into a wood board, realizing the junction of wood boards.

In this embodiment, in cases that an operator actuates the trigger, the trigger will move in the direction near the gun body 9 and impress the spring member. At that time, a scavenging air valve is opened to fill compressed air into the cylinder body, and the piston 7 is driven to move in the first direction under the impact of the compressed air in the cylinder body. As the nailing plate 6 is fixedly connected to the piston 7, the movement of the nailing plate 6 and the piston 7 is synchronized. Therefore the nailing plate 6 strikes straight nails or staple nails at the position of the nail outlet 4 into the wood board.

More specifically, the thickness and the nailing plate 6 matches the thickness of the nail discharge groove 15; Said nailing plate 6 is disposed in the nail discharge groove 15, and is driven to reciprocate therein by the driving unit. In this embodiment, the widths of nail discharge groove 15 basically cover the specification requirements of various staple nails in the market. Therefore, operators needn't to buy different models of nail gun to satisfy different working requirements, thus reducing cost and enhancing universality and facilitation.

It is to be noted that, in this embodiment, a nailing positioning means 20 is provided in the gun body 9 at the front end of the nailing unit. The nailing positioning means 20 comprises a positioning piece 21, a reset shrapnel 22 and a first guide plate 23, which are sequentially arranged; The tail of the first guide plate 23 is socket-connected with a spring member 24; the tail end of first guide plate 23 contacts the reset shrapnel 22. The first guide plate 23 extends beyond the outer end of the gun body 9, and reciprocates by the coordinated actions of the spring member 24 and the reset shrapnel 22.

In this embodiment, after finishing the procedure of mounting straight nails or staple nails, the operator can put the first guide plate 23 of the nail gun against the wood board. As the first guide plate 23 is disposed at the front end of the nailing plate 6, the operator should calculate the distance between the first guide plate 23 and the nailing plate 6 before nailing, and aim the bottom of the nail gun at the target position of the wood board. The first guide plate 23 firstly contacts the wood board and is in the state of impressed spring member 24 and the reset shrapnel 22. When the first guide plate 23 is at the same plane as the bottom of the nail gun and the wood board, the operator may actuate the trigger. Now, the nailing plate 6 strikes straight nails or staple nails at the nail outlet 4 into a wood board. The operator can repeat the process until the nailing work is finished. By the arrangement of nailing positioning means in working process of nail gun, an operator can position the nail gun according to actual needs, thus avoiding nailing mistake, improving working efficiency and significantly reducing manufacturing costs.

The other contents of this example can refer to example 1.

The above description of published embodiments enables the persons skilled in the art can realize or use the present invention. Various modifications of these embodiments are obvious to those skilled in the art. The general principle according to the present invention can be embodied in other examples without departing from the spirit and scope of the invention as defined by the appended claims. Hence, the present invention shall not be limited to the embodiments shown in in the specification but to the widest range conforming to principles and novel features that are disclosed in this paper.

Although specific terms are employed herein, such as, guide plate 1, nail box 2, nail feeding plate 3, nail outlet 4, bump 5, nailing plate 6, piston 7, locking device 8, gun body 9, nail box locking unit 10, junction plate 11, hook slot 13, nail discharge groove 15, nailing positioning means 20, positioning piece 21, reset shrapnel 22, first guide plate 23, spring member 24 and the like, is also possible for the present invention to use other terms. The above terms are merely intended to describe and demonstrate the essence of the present invention easily and conveniently. It is a departure from the spirit of the invention to construe these terms as an additional limitation.

The invention claimed is:

1. A nailing unit, comprising a guide plate (1), a nail box (2) to mount staple nails or straight nails, and a nail feeding plate (3) slidably connected to said nail box (2);

wherein said nail box (2) being fixedly connected to said guide plate (1) at one end and form a nail outlet (4) at the position of connection;

said nail feeding plate (3) being able to push staple nails or straight nails to the nail outlet (4);

two cuboid-shaped bumps (5) being fixedly provided inboard of said guide plate (1) lengthwise, and the two bumps are symmetrically provided at both sides of the guide plate (1) in the nail outlet (4).

2. A nailing unit, comprising a guide plate (1), a nail box (2) to mount staple nails or straight nails, and a nail feeding plate (3) slidably connected to said nail box (2); wherein said nail box (2) being fixedly connected to said guide plate (1) at one end and form a nail outlet (4) at the position of connection; said nail feeding plate (3) being able to push staple nails or straight nails to the nail outlet (4); two cuboid-shaped bumps (5) being fixedly provided inboard of said guide plate (1) lengthwise, and the two bumps are symmetrically provided at both sides of the guide plate (1) in the nail outlet (4), wherein said bumps (5) and the guide plate (1) take the form of step, and therefore form a nail discharge groove (15) between the bumps (5) and the nail outlet (4).

3. A nail gun according to claim 2, comprising a gun body (9), a nailing plate (6) for striking staple nails or straight nails in said nail discharge groove (15), and a driving unit for controlling said nailing plate (6) to reciprocate and a switch assembly for controlling ON-OFF switch of said driving unit; wherein said nailing plate (6) and said driving unit being all arranged in said gun body (9).

4. A nail gun according to claim 3, comprising a cylinder body fixedly disposed in said gun body (9) and a piston (7) disposed in said cylinder body; wherein said piston (7) being slidably connected to said cylinder body, and said nailing plate (6) being fixedly connected to said piston (7).

5. A nail gun according to claim 4 wherein the thickness of said nailing plate (6) matches the thickness of the nail discharge groove (15);

wherein said nailing plate (6) being disposed in the nail discharge groove (15) and driven to reciprocate therein by the driving unit.

6. A nail gun according to claim 5 comprising a locking unit (10) for the nail box;

wherein the locking unit (10) for the nail box comprising a locking device (8) fixedly arranged at the end of the nail feeding plate (3);

wherein junction plates (11) being fixedly provided at both sides of said locking device (8);

wherein hook slots (13) are provided in the junction plates (11), and responsively the gun body (9) is provided with positioning slots to match the hook slots (13);

wherein the hook slots (13) being snap-in connected to the positioning slots to fix the position of the nail feeding plate (3) in the nail box (2).

7. A nail gun according to claim 6 wherein a nailing positioning unit (20) being disposed in said gun body (9) at the front end of the nailing unit;

wherein the nailing positioning unit (20) comprising a positioning piece (21), a reset shrapnel (22) and a first guide plate (23) in the order of arrangement;

wherein the tail of the first guide plate (23) being socket-connected with a spring member (24), and the tail end of the first guide plate (23) contacting the reset shrapnel (22);

wherein the first guide plate (23) extending to the outer end of the gun body (9) and reciprocating by the coordinated actions of the spring member (24) and the reset shrapnel (22).

8. A nail gun according to claim 7, wherein said nail gun is an electric nail guns, a manual nail guns or a pneumatic nail guns.

9. A nail gun according to claim 6, wherein said nail gun is an electric nail guns, a manual nail guns or a pneumatic nail guns.

10. A nail gun according to claim 5, wherein said nail gun is an electric nail guns, a manual nail guns or a pneumatic nail guns.

11. A nail gun according to claim 2, comprising a gun body (9), a nailing plate (6) for striking staple nails or straight nails in said nail discharge groove (15), and a driving unit for controlling said nailing plate (6) to reciprocate and a switch assembly for controlling ON-OFF switch of said driving unit; wherein said nailing plate (6) and said driving unit being all arranged in said gun body (9);

wherein said nail gun also comprises a cylinder body fixedly disposed in said gun body (9) and a piston (7) disposed in said cylinder body; wherein said piston (7) being slidably connected to said cylinder body, and said nailing plate (6) being fixedly connected to said piston (7);

wherein the thickness of said nailing plate (6) matches the thickness of the nail discharge groove (15);

wherein said nailing plate (6) being disposed in the nail discharge groove (15) and driven to reciprocate therein by the driving unit;

wherein said nail gun also comprises a locking unit (10) for the nail box;

wherein the locking unit (10) for the nail box comprising a locking device (8) fixedly arranged at the end of the nail feeding plate (3);

wherein junction plates (11) being fixedly provided at both sides of said locking device (8);

wherein hook slots (13) are provided in the junction plates (11), and responsively the gun body (9) is provided with positioning slots to match the hook slots (13);

wherein the hook slots (13) being snap-in connected to the positioning slots to fix the position of the nail feeding plate (3) in the nail box (2);

wherein a nailing positioning unit (20) being disposed in said gun body (9) at the front end of the nailing unit;

wherein the nailing positioning unit (20) comprising a positioning piece (21), a reset shrapnel (22) and a first guide plate (23) in the order of arrangement;

wherein the tail of the first guide plate (23) being socket-connected with a spring member (24), and the tail end of the first guide plate (23) contacting the reset shrapnel (22);

wherein the first guide plate (23) extending to the outer end of the gun body (9) and reciprocating by the coordinated actions of the spring member (24) and the reset shrapnel (22).

12. A nail gun according to claim 11, wherein said nail gun is an electric nail guns, a manual nail guns or a pneumatic nail guns.

* * * * *